United States Patent [19]

Sallenbach

[11] Patent Number: 4,994,127

[45] Date of Patent: Feb. 19, 1991

[54] METHOD FOR REPAIRING HOSIERY

[76] Inventor: Sherry K. Sallenbach, 3359 Marigold Cir., Costa Mesa, Calif. 92626

[21] Appl. No.: 458,560

[22] Filed: Dec. 28, 1989

[51] Int. Cl.[5] ..... B32B 35/00

[52] U.S. Cl. ..... 156/64; 2/409; 156/94; 156/278; 156/305; 264/36; 427/140; 428/63

[58] Field of Search ..... 2/239, 241, 243 R, 409; 156/94, 98, 278, 280, 305, 64; 264/36; 427/140; 428/63

[56] References Cited

U.S. PATENT DOCUMENTS 2,172,251 9/1939 Copeman .

3,772,114 11/1973 Kowalchuk ..... 156/94 X 4,047,300 9/1977 Sweeney ..... 156/98 X 4,068,322 1/1978 Natel ..... 156/94 X

*Primary Examiner*—Robert A. Dawson

*Attorney, Agent, or Firm*—Poms, Smith, Lande & Rose

[57] ABSTRACT

The present invention relates to a method of mending runs, snags, holes or the like in hosiery by the application of adhesive material. A single application applicator may be used. The preferred adhesive is biocompatible so that the adhesive may be applied while the hosiery is being worn; and the preferred adhesive is a cyanoacrylic adhesive. Decorative material such as dyes, glitter or other decorative material may be added to the adhesive to match or to decorate the hosiery.

19 Claims, 1 Drawing Sheet

METHOD FOR REPAIRING HOSIERY

BACKGROUND OF THE INVENTION

Hosiery, for example pantyhose, are fine, thinly-knit articles of clothing worn over the legs of women. Hosiery, however, has a tendency to easily develop rips, tears, holes and runs, usually caused by objects catching or snagging them. The prices of pantyhose range in cost from about $2.00 to about $20.00, depending on their quality, brand, size, color and pattern. Any tear or run in the pantyhose results in the wearer disposing of them. This problem often causes the wearer to spend a considerable amount of money replacing them over the course of time, especially when the imperfection appears on the first day of use.

Furthermore, another problem with pantyhose is that they tend to tear or run while they are worn on the woman's legs. This often causes embarrassment and inconvenience to the wearer since they are difficult and virtually impossible to repair on the spot.

Attempts have been made to repair hosiery that have developed tears, rips, holes or runs. One way in which an imperfection such as a run, snag, hole or the like in the hosiery is sealed is by applying a clear fingernail enamel thereto. This method, however, provides only a temporary repair, and repeated stress and/or stretching causes the nail polish enamel to give way, thus causing the pantyhose to run. Furthermore, clear nail polish enamel will neither hold nor allow for overlap repair holding of the pantyhose or other hosiery.

U.S. Pat. No. 4,068,322 relates to a pantyhose mender and a method for mending a snag in pantyhose. This patent discloses a decorative mending device for placement over the snag or run on the outside of the pantyhose and a matching piece for placement over the snag or run on the inside of the pantyhose. Each member has a waterproof adhesive on the inside surface allowing the members to be adhesively pressed together to decoratively repair the snag. Even though this device is capable of mending a snag or run in pantyhose, it often requires the wearer to take her pantyhose off each time an imperfection in the pantyhose exists. In order to place the matching backup piece on the inside of her pantyhose. Therefore, this device cannot be used if a rip occurs at a location where the wearer has no access to removal of her pantyhose. Accordingly, this method of repairing runs and snags in pantyhose may prove to be impossible or at least inconvenient. Moreover, even though this mending device may decorate and repair runs and snags in pantyhose, if the rip or run is considerably large, this device may be so large that it may be aesthetically unappealing and may no adequately repair the damaged pantyhose. Therefore, in light of the prior art, there is no known method of both conveniently and permanently repairing rips, tears, holes and runs in hosiery.

Reference is also made to L. G. Copeman, U.S. Pat. No. 2,172,251, which discloses dipping hosiery into latex to coat stockings and prevent runs, but with the obvious adverse effect on appearance.

SUMMARY OF THE INVENTION

The present invention relates to a new and improved method of conveniently and permanently mending imperfections such as runs, snags, holes or the like in hosiery by eliminating all of the problems inherent in the above-described disclosure.

The present invention teaches a method of mending rips, tears, snags and runs in hosiery, for example, pantyhose, whereby a biocompatible adhesive, which is encased in a one-shot plastic container and applicator, is applied to the imperfection(s) to either prevent the rips, runs or holes from further spreading or to close up the holes or runs.

As opposed to mending pantyhose with clear fingernail enamel, the present invention will not give way with repeated stress or stretching. In addition, the present invention will permanently hold a rolled overlap repair seam.

Furthermore, the adhesive used in the present invention may be colored, frosted, glittered, marbleized, or provided with metallic particles, for examples, in order to decorate or match the type of pantyhose or hosiery to which it is applied. These different varieties of adhesives may also be applied for decorative purposes.

The present invention also may be provided in one-shot plastic containers or applicators, allowing the user to simply apply the adhesive to the hosiery and dispose of the unused adhesive and the container.

It is an object of the present invention to provide a new improved method of mending hosiery using a biocompatible adhesive compound, preferably a cyanoacrylate.

Another object is to provide a method of permanently holding and stopping runs or tears in hosiery from spreading or giving way when repeated stress of stretching of the hosiery occurs.

Another object of the present invention is to allow the wearer to conveniently mend ripped pantyhose on the spot without taking them off at an inconvenient location.

An additional object of the present invention is to apply an adhesive which will mend the damaged hosiery so that the hosiery may be reworn rather than discarded.

Still another object is to package the adhesive in an easy to use, one-shot plastic applicator.

A further object of the present invention is to provide a hosiery and pantyhose mender which can be used for repair and decorative purposes.

DETAILED DESCRIPTION OF THE PREFERRED EMBODIMENT

Figure 1:
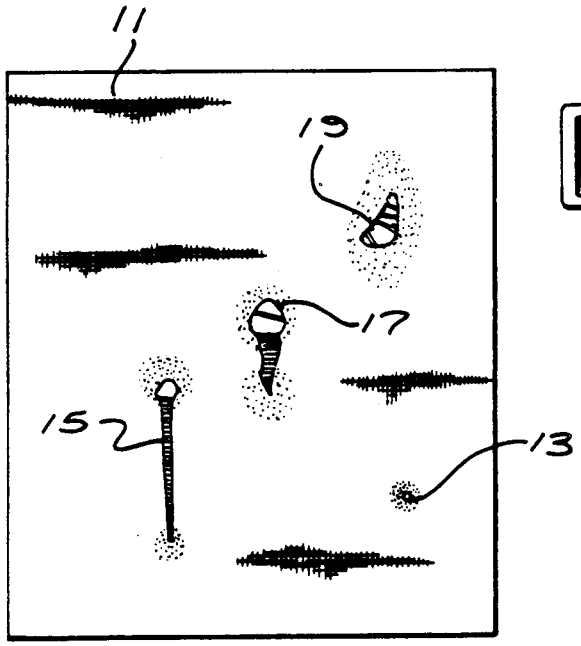
FIG. 1 shows a portion of a stocking mounted on a cardboard backing member showing the results of clear fingernail enamel applied to snags, runs, holes and rips in hosiery.
Figure 2:
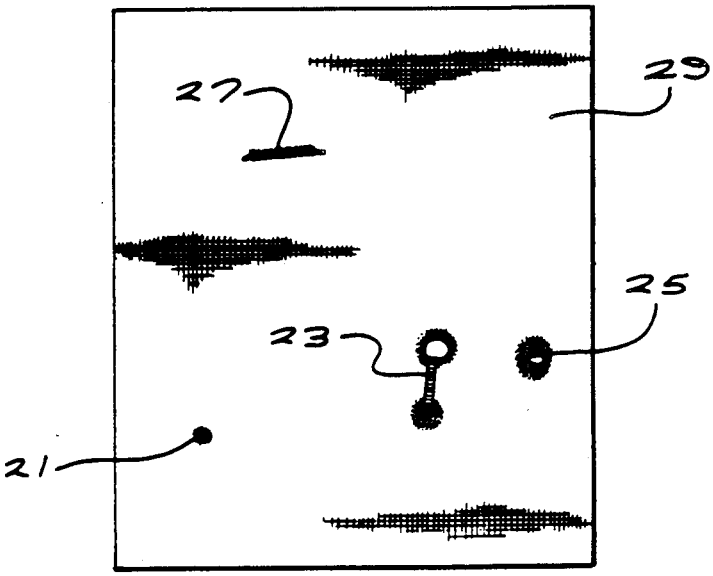
FIG. 2 shows a portion of a stocking mounted on a cardboard backing member showing the results of adhesive of the present invention applied to snags, runs, holes and rips.

FIGS. 1 and 2 illustrate the differences between how the nail polish enamel and the adhesive used in the present invention repair various types of damage that may happen to pantyhose or other hosiery.

FIG. 1 shows the appearance of clear nail polish enamel used in mending a snag 13, a run 15, a hole 17 and rip 19 on ordinary nylon stockings 11, shown mounted on a cardboard backing sheet.

FIG. 2 shows how the cyanoacrylate, or cyanoacrylic adhesive, mends a snag or potential run 21, a run 23, a hole 25 and a rip 27 on an ordinary nylon stocking 29.

FIG. 1 illustrates that, at the stocking rip 19, the clear nail polish is unsuccessful in holding and allowing for overlap repair of the nylon stocking 11; whereas FIG. 2 illustrates that the adhesive will hold permanently for an overlap or rolled overlap repair seam 27 when the nylon stocking 29 rips. It is also noted that the use of the clear plastic nail polish is only a temporary expedient, as use of the hosiery stretches the fabric and renders the nail polish ineffective for stopping further running of the hosiery.

Considering the frequency that women go through pantyhose and other types of hosiery, an important advantage is that the method set forth by the present invention allows for rewearing hosiery instead of replacing it.

Furthermore, colored, metallic, frosted, glittered or marbleized adhesive may be used for decorative and repair purposes by the addition of such materials either as dyes or as the particles to the adhesive.

Many different types of adhesive may be used in repairing rips, holes and snags in hosiery. The types of adhesive which may be used include silicone adhesives, epoxy adhesives, urethane adhesives, polyester adhesives or a cyanoacrylic adhesive, by way of examples.

Other adhesives as identified, for example, in Chapter 1, pages 106–125, of a text entitled *Plastics Chemistry and Technology*, by W. E. Driver, ©1979 Van Nostrand Reinhold, may be used.

In the present invention, it is preferred that cyanoacrylate adhesive be used to mend the damaged hosiery.

The ingredients of the cyanoacrylate adhesive are set forth in Table 1 in their preferred amounts:

TABLE 1

| Ingredients | Percent by Weight |
|---|---|
| Ethyl Cyanoacrylate | 95–100 |
| Poly(methyl methacrylate) | 3–5 |
| Hydroquinine | 0.5 |

Furthermore, it is preferred that the adhesive set forth in the present invention be biocompatible, and cyanoacrylic adhesive has this advantageous property. Therefore, the adhesive will not have any toxic or other detrimental effects when and if it comes in contact with the human skin. In cases where the adhesive is only applied following removal of the hosiery, it is not critical that biocompatible adhesives be used.

Figure 3:
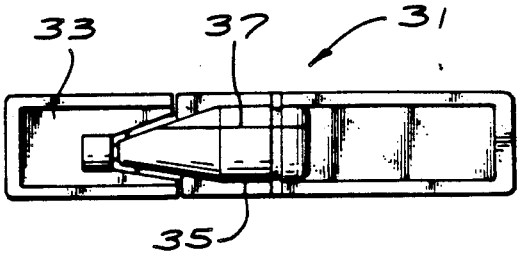
FIG. 3 is a top view of a "one-shot" plastic container containing hosiery mending adhesive.

FIG. 3 is a top view of a "one-shot" or single application plastic dispenser 31, containing liquid adhesive. The entire unit may be about 2-⅝ inches long, with the left-hand side 33 in FIG. 3 constituting a closure for the adhesive, which may be removed by bending back and forth or twisting. The central portion 35 contains the adhesive 37, and the flat right-hand end serves as a holder or handle for the unit.

Figure 4:
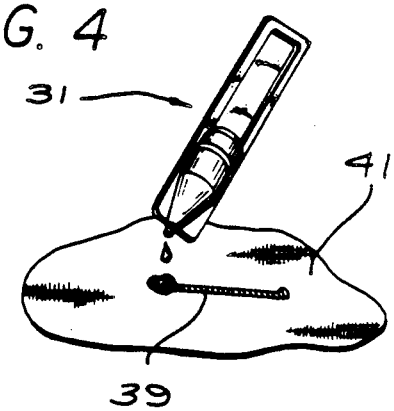
FIG. 4 is a perspective view of the one-shot plastic container being used to apply the adhesive composition to hosiery.

In FIG. 4, the unit 31 is shown with the closure end 33 removed, and with adhesive being applied to the run 39 in hosiery 41.

In conclusion, it is to be understood that the foregoing detailed description and the accompanying drawings relate to an illustrative embodiment and method of the invention, but is not to be considered to be exhaustive. Thus, by way of example and not of limitation, the adhesive may be dispensed from other, larger containers, and other adhesives may be employed. Accordingly, the present invention is not limited to the method, adhesives or dispenser as described in detail hereinabove.

What is claimed is:

1. A method for mending hosiery comprising the steps of:
   - putting the hosiery on;
   - detecting an imperfection such as a run, snag, hole or the like in the hosiery;
   - opening a one-shot application container having a biocompatible adhesive therein;
   - applying said biocompatible adhesive to the imperfection while the hosiery is being worn;
   - permitting the adhesive to dry to form a permanent repair for the hosiery; and
   - repeatedly reusing the repaired hosiery.

2. A method for mending hosiery as defined in claim 1, wherein said adhesive which is applied is selected from the group consisting of cyanoacrylate, silicone adhesive, an epoxy adhesive, a urethane adhesive, or a polyester adhesive.

3. A method for mending hosiery as defined in claim 2 including the step of adding decorative material to said adhesive.

4. A method for mending hosiery as defined in claim 1 including the step of packaging said adhesive in a disposable, one-shot application container.

5. A method for mending hosiery as defined in claim 1 including the step of forming a rolled overlap seam in the area of the imperfection and applying said adhesive to firmly fix said rolled overlap seam against further running.

6. A method as defined in claim 1 wherein said adhesive which is applied is a cyanoacrylic adhesive.

7. A method for mending hosiery comprising the steps of:
   - detecting an imperfection, such as a run, snag, hole or the like, in hosiery;
   - opening a container having a biocompatible adhesive therein;
   - applying the adhesive to the imperfection without using any supplemental sheet material;
   - permitting the adhesive to dry to form a permanent repair for the hosiery without using any supplemental sheet material and
   - repeatedly stretching and stressing the repaired hosiery without damaging the repaired area.

8. A method for mending hosiery as defined in claim 7 wherein said adhesive is selected from the group consisting of cyanoacrylate, a silicone adhesive, an epoxy adhesive, a urethane adhesive or a polyester adhesive.

9. A method for mending hosiery as defined in claim 7 wherein said adhesive which is applied may be, for example, metallic, frosted, glittered, colored or marbleized.

10. A method for mending hosiery as defined in claim 7 including the step of forming a rolled overlap seam in the area of the imperfection and applying said adhesive to firmly fix said rolled overlap seam against further running.

11. A method for mending hosiery as defined in claim 7 wherein said adhesive which is being applied is a cyanoacrylic adhesive.

12. A method for mending hosiery comprising the steps of:

detecting an imperfection such as a run, snag, hole or the like in hosiery;

opening a container having an adhesive contained therein;

applying said adhesive from the container to the imperfection in the hosiery without using any supplemental sheet material;

permitting the adhesive to dry to form a permanent repair for the hosiery without using any supplemental sheet material; and repeatedly stretching and stressing the repaired hosiery without damaging the repaired area.

13. A method for mending hosiery as defined in claim 1 wherein said adhesive which is applied is selected from the group consisting of cyanoacrylate, silicone adhesive, an epoxy adhesive, a urethane adhesive or a polyester adhesive.

14. A method for mending hosiery as defined in claim 12 including the step of adding decorative material to said adhesive.

15. A method for mending hosiery as defined in claim 12 wherein the adhesive which is applied is a biocompatible adhesive.

16. A method for mending hosiery comprising the steps of:

detecting an imperfection, such as a run, snag, hole or the like, in hosiery;

packaging a biocompatible adhesive in a disposable, one-shot application container;

opening said container;

applying the adhesive to the imperfection;

permitting the adhesive to dry to form a permanent repair for the hosiery; and repeatedly reusing the repaired hosiery.

17. A method for mending hosiery comprising the steps of:

detecting an imperfection such as a run, snag, hole or the like in hosiery;

packaging an adhesive in a disposable, one-shot application container;

opening said container;

applying said adhesive from the container to the imperfection in the hosiery;

permitting the adhesive to dry to form a permanent repair for the hosiery; and repeatedly reusing the repaired hosiery.

18. A method for mending hosiery comprising the steps of:

detecting an imperfection such as a run, snag, hole or the like in hosiery;

opening a container having an adhesive contained therein, said adhesive being a cyanoacrylic adhesive;

applying said adhesive from the container to the imperfection in the hosiery;

permitting the adhesive to dry to form a permanent repair for the hosiery; and repeatedly reusing the repaired hosiery.

19. A method for mending hosiery comprising the steps of:

detecting an imperfection, such as a run, snag, hole or the like, in hosiery;

opening a container having an adhesive therein;

forming a rolled overlap seam in the area of said imperfection;

applying said adhesive to firmly fix said rolled overlap seam against further running; and permitting the adhesive to dry to form a permanent repair for the hosiery.

* * * * *